US006634515B2

(12) United States Patent
Nerger et al.

(10) Patent No.: US 6,634,515 B2
(45) Date of Patent: Oct. 21, 2003

(54) LIFTING APPARATUS FOR IMPLEMENTING A RECTILINEAR MOVEMENT OF A HANDLING DEVICE

(75) Inventors: Klaus Nerger, Neukirchen-Vluyn (DE); Eberhard Becker, Hagen (DE); Stefan Noll, Leichlingen (DE); Manfred Stöber, Witten (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 10/006,184

(22) Filed: Dec. 3, 2001

(65) Prior Publication Data

US 2002/0066891 A1 Jun. 6, 2002

Related U.S. Application Data

(60) Provisional application No. 60/260,578, filed on Jan. 8, 2001.

(30) Foreign Application Priority Data

Dec. 5, 2000 (DE) ..... 100 61 343

(51) Int. Cl.[7] ..... B66C 19/00

(52) U.S. Cl. ..... 212/333; 212/319; 384/58

(58) Field of Search ..... 212/319, 333, 212/334, 335; 254/387; 384/58

(56) References Cited

U.S. PATENT DOCUMENTS 3,819,061 A * 6/1974 Andersson et al. ..... 214/1 BB
4,557,165 A * 12/1985 Werkmeister et al. ..... 82/2.7
4,566,738 A * 1/1986 Fasth ..... 308/3 A
4,648,777 A * 3/1987 Eichenauer ..... 414/591
5,183,377 A * 2/1993 Becker et al. ..... 414/751
5,341,751 A * 8/1994 Cuneo et al. ..... 108/143
5,445,045 A * 8/1995 Nagai et al. ..... 74/490.09
5,689,994 A * 11/1997 Nagai et al. ..... 74/89.15
5,799,543 A * 9/1998 Nagai et al. ..... 74/490.09
6,145,404 A * 11/2000 Maffeis et al. ..... 74/490.02

FOREIGN PATENT DOCUMENTS

| | | |
|---|---|---|
| DE | 41 11 551 A | 10/1992 |
| DE | 43 42 716 A1 | 6/1995 |
| DE | 195 02 986 A | 9/1995 |
| DE | 299 19 136 U | 3/2001 |
| EP | 0 751 090 A | 1/1997 |

* cited by examiner

*Primary Examiner*—Thomas J. Brahan
(74) *Attorney, Agent, or Firm*—Henry M. Feiereisen

(57) ABSTRACT

A lifting apparatus includes two parallel longitudinal members interconnected by at least one connecting element. A lifting beam is movable by a drive mechanism along the longitudinal members and supports, directly or indirectly, a handling device. Extending parallel to and supporting the lifting beam is a guide rail, which is received in spaced-apart carriages, for displacement in longitudinal direction in a freely running manner, as the lifting beam is moved by the drive mechanism. The carriages are arranged in a space between the longitudinal members and secured to the connecting element, wherein the longitudinal members and the lifting beam are formed with longitudinal grooves for engagement of sliding blocks so that the connecting element, the drive mechanism and the carrying unit are securable to the longitudinal members in any desired longitudinal position, and the guide rail is securable to the lifting beam in any desired longitudinal position.

12 Claims, 5 Drawing Sheets

LIFTING APPARATUS FOR IMPLEMENTING A RECTILINEAR MOVEMENT OF A HANDLING DEVICE

CROSS-REFERENCES TO RELATED APPLICATIONS

This application claims the benefit of prior filed provisional application, Appl. No. 60/260,578, filed Jan. 8, 2001, pursuant to 35 U.S.C. 119(e), the subject matter of which is incorporated herein by reference.

This application claims the priority of German Patent Application Serial No. DE 100 61 343.8, filed Dec. 5, 2000, the subject matter of which is incorporated herein by reference.

BACKGROUND OF THE INVENTION

The present invention relates, in general, to a lifting apparatus for implementing a rectilinear movement of a handling device, e.g., a manually-operated manipulator.

Such a vertical lifting apparatus in the manner of a lifting upright for a manually guided manipulator is known, for example, from German Pat. No. DE 43 42 716 A1. The lifting apparatus includes a longitudinal member to serve as guide part, and a lifting beam which is guided on the longitudinal member for movement in a longitudinal direction. The lifting beam has a lower end for attachment of a load-receiving member. Operation of the lifting beam is implemented by a drive in the form of a cylinder which is actuated by a pressure medium and securely fixed to the longitudinal member. The cylinder has a movable part a piston which is connected to the lifting beam.

This lifting apparatus suffers shortcomings because of the complexity to suit the lifting apparatus to different operating conditions.

It would therefore be desirable and advantageous to provide an improved lifting apparatus for realizing a rectilinear movement of a handling device, which obviates prior art shortcomings and is easy to suit to different operating situation, while being producible in almost any desired length and adaptable to a wide range of different length requirements, such as, e.g., to the length of the lifting beam and to the fastening height of the lifting apparatus.

SUMMARY OF THE INVENTION

According to one aspect of the present invention, a lifting apparatus for implementing a rectilinear movement of a handling device, includes a pair of longitudinal members arranged in parallel relationship in a common plane at formation of a space therebetween and securable to a stationary or movable carrying unit; at least one connecting element rigidly interconnecting the longitudinal members; a drive mechanism; a lifting beam movable by the drive mechanism longitudinally along the longitudinal members and having attached thereon, directly or indirectly, the handling device; and a guide rail extending parallel to and supporting the lifting beam, wherein the guide rail is received in guide elements, arranged at a distance behind one another, for displacement in longitudinal direction in a freely running manner as the lifting beam is moved by the drive mechanism, wherein the guide elements are arranged in the space between the longitudinal members and secured to the connecting element, wherein the longitudinal members and the lifting beam are formed with longitudinal grooves for engagement of sliding blocks so that the connecting element, the drive mechanism and the carrying unit are securable to the longitudinal members in any desired longitudinal position, and the guide rail is securable to the lifting beam in any desired longitudinal position.

The present invention resolves prior art problems by providing a lifting apparatus in which the essential length-determining elements, i.e., the lifting beam and the two parallel longitudinal members, are provided with continuous longitudinal grooves for cooperation with fasteners that engage behind the grooves. As a consequence, the lifting beam and the longitudinal members may be made from aluminum profiles of square or rectangular cross section, which have been produced preferably through extrusion. Aluminum profiles can be cut to size in any desired length and can be produced very cost-effectively. The provision of longitudinal grooves allows the user to suit the position of the lifting beam to the situation at hand before fastening. Furthermore, the longitudinal members may be mounted to a trolley at a desired height, without need for any additional measures. In case of changes to the work area, the height can thus be altered to new height conditions (trolley/handling device spacing) in an easy manner by few manipulations.

According to another feature of the present invention, the guide elements may include a recirculating bearing, thereby allowing easy guidance of the lifting beam at little amount of play.

According to another feature of the present invention, the connecting element is may be provided by a metal plate which is easy to produce.

According to another feature of the present invention, the drive mechanism may be implemented by a cable balancer having a cable secured to a lower end of the lifting beam. This configuration is suitable, in particular, for a vertical lifting beam which, by way of their own weight move automatically downward into a position predetermined by the cable length.

The handling device, which may be a load-receiving member or a tool, may be fastened, for example, to an intermediate attachment element which is a horizontal member designed as an aluminum profile. Suitably, the attachment element is mounted to the lifting beam via a load-moment support.

According to another feature of the present invention, the longitudinal members may have stop members secured by sliding blocks for limiting a lifting path of the lifting beam.

BRIEF DESCRIPTION OF THE DRAWING

Other features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
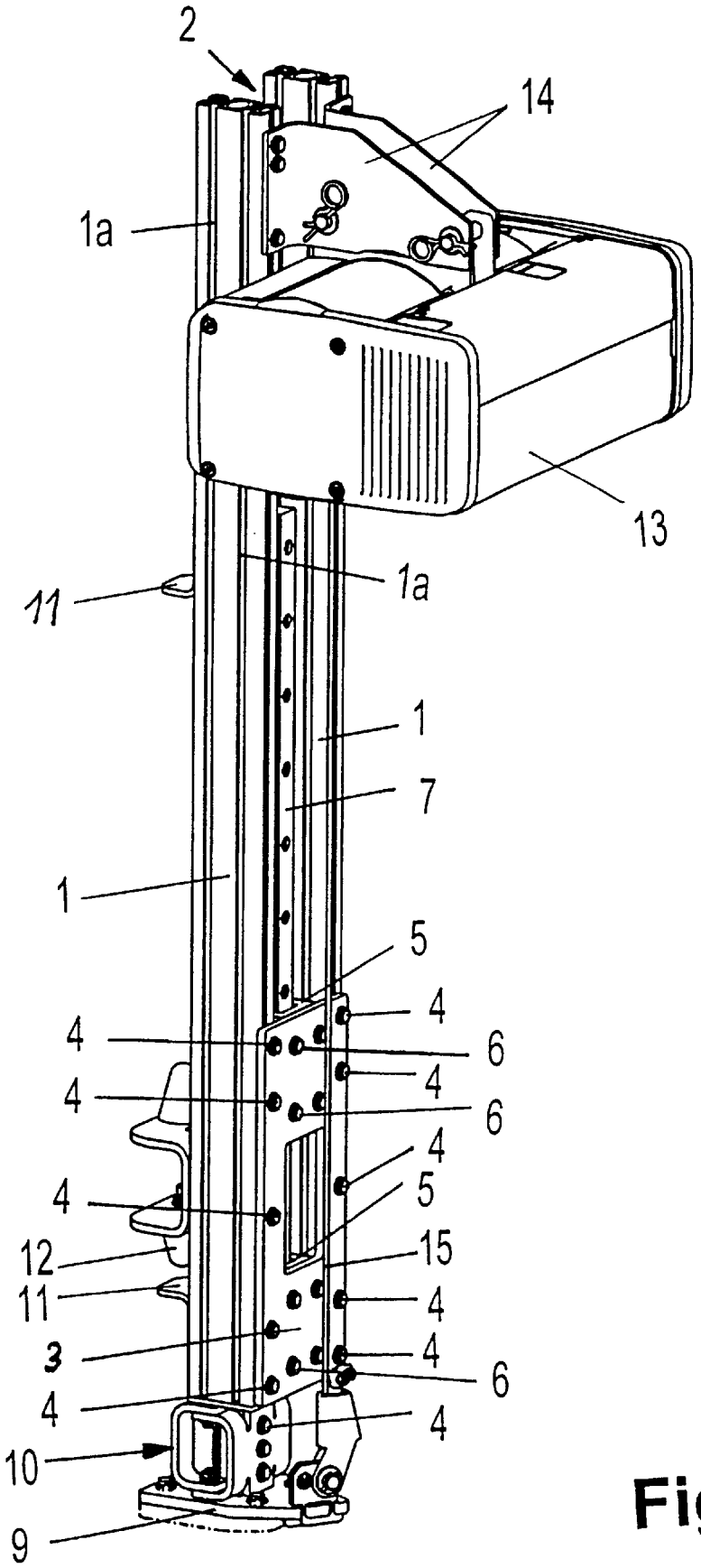
FIG. 1 is a perspective illustration of a lifting apparatus according to the present invention.

Throughout all the Figures, same or corresponding elements are generally indicated by same reference numerals.

Turning now to the drawing, and in particular to FIG. 1, there is shown a perspective illustration of a vertical lifting apparatus according to the present invention having an upper end for attachment to a trolley as a moveable carrying apparatus, as will be described in more detail with reference to FIG. 5. In this way, the lifting apparatus can be moved in a horizontal direction. Of course, the lifting apparatus may certainly also be fixedly secured, for example to a support beam in a ceiling region of an assembly building or to a wall mounting.

Figure 2:
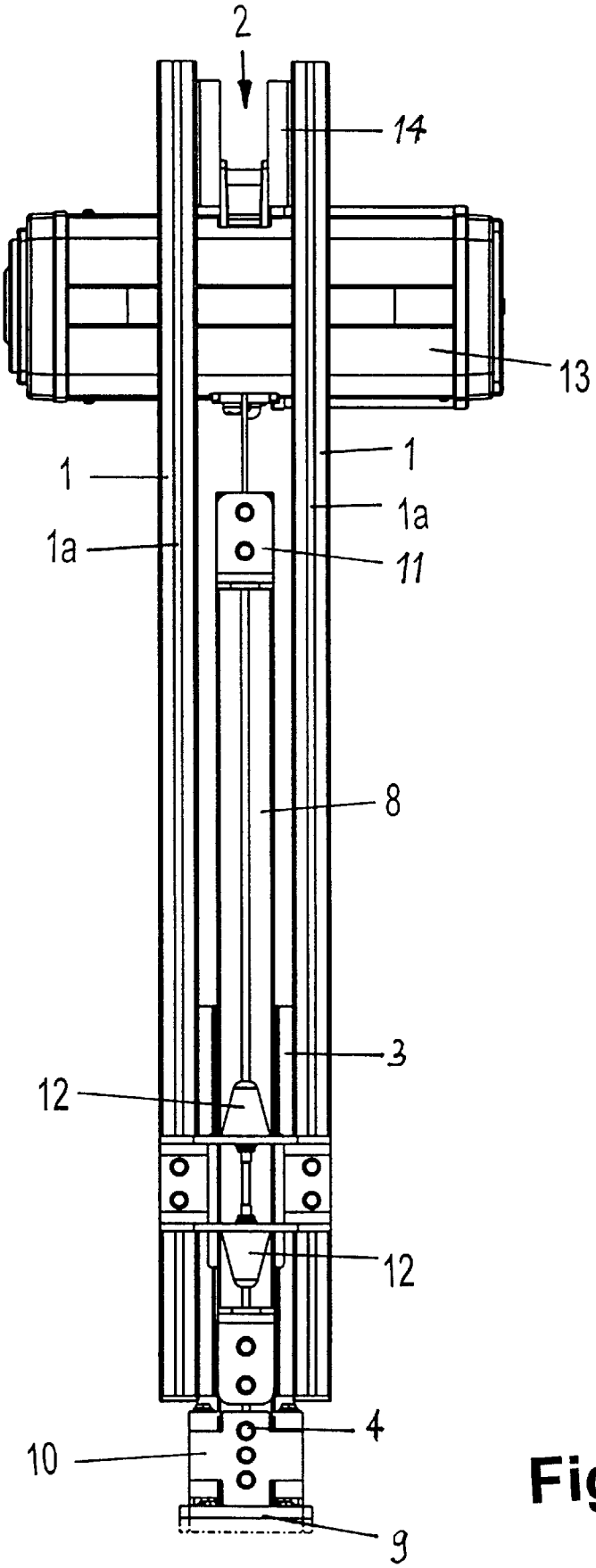
FIG. 2 is a front view of the lifting apparatus of FIG. 1.
Figure 3:
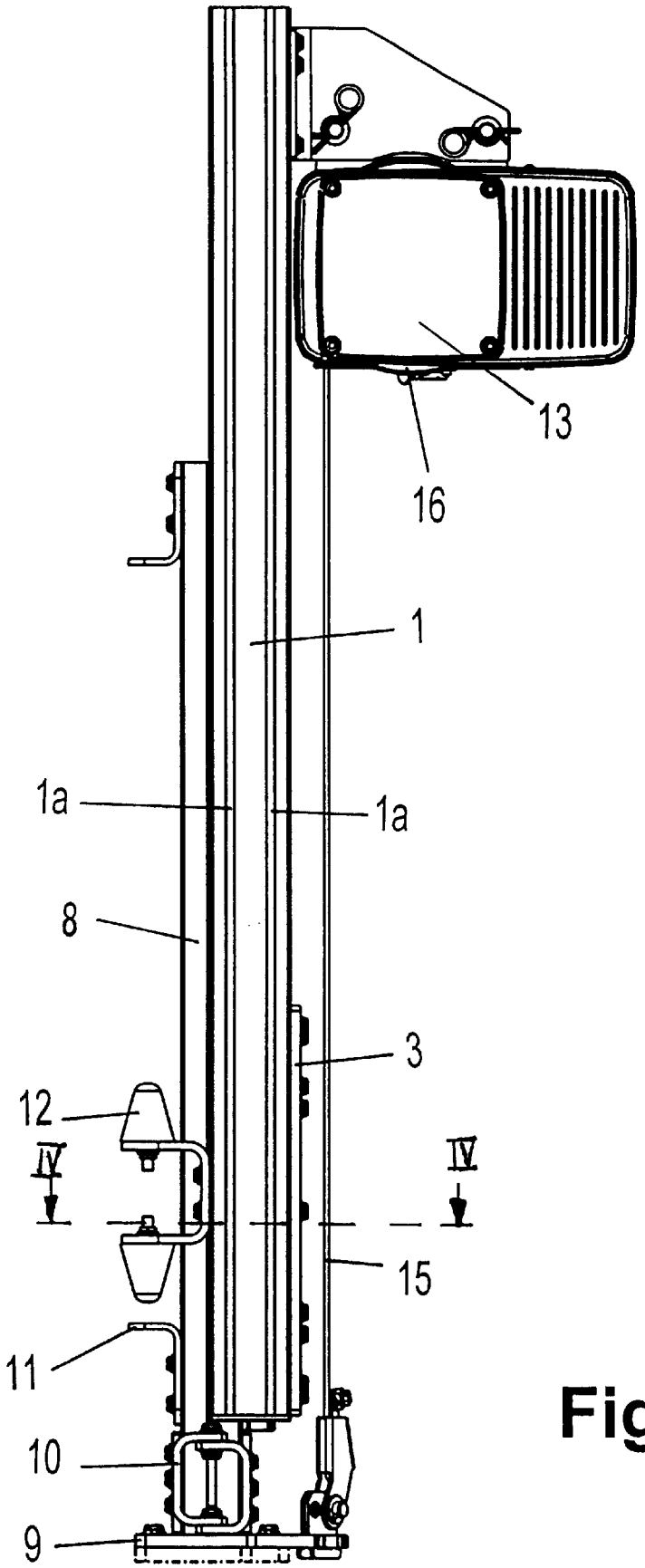
FIG. 3 is a side view of the lifting apparatus of FIG. 1.
Figure 4:
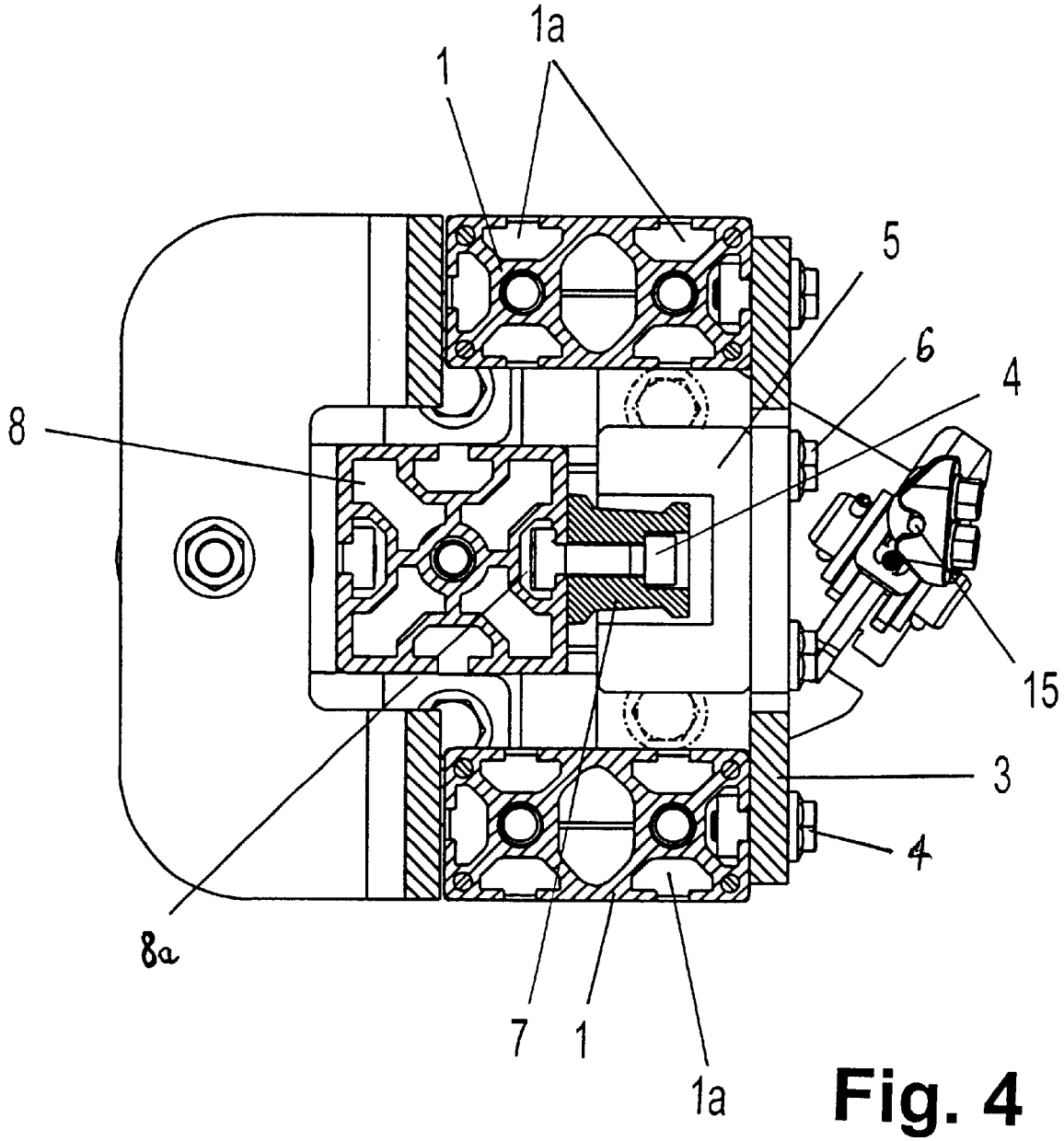
FIG. 4 is a cross section of the lifting apparatus, taken along the line IV—IV in FIG. 3.

As shown in particular in FIGS. 2 and 3, the lifting apparatus includes two longitudinal members 1, which are arranged in parallel relationship in a common plane at a distance to one another to thereby define a space 2 therebetween. The two longitudinal members 1 are rigidly interconnected transversely to one another by an intermediate connecting element 3 in the form of a metal plate. As best seen in FIG. 4, each of the longitudinal members 1 is formed on its outer sides with longitudinal grooves 1*a* to allow securement of the connecting element 3 to the longitudinal members 1 via suitable sliding blocks 4, which engage behind the longitudinal grooves 1*a*. Of course, it is also possible to use sliding-block strips for realizing a securement of the connecting element 3.

Fastened to the inside of the connecting element 3 by screw fasteners 6 are two guide elements 5 which include a, not shown, recirculating ball bearing and are spaced from one another in longitudinal direction so as to be located at the top and bottom of the connecting element 3. A guide rail 7 is slidably received by the two guide elements 5 so as to run freely in the longitudinal direction thereof. The guide rail 7 and the two guide elements 5 are arranged in the space 2 between the two longitudinal members 1, as shown in particular in FIG. 4.

The guide rail 7 carries a lifting beam 8 in parallel relationship thereto, as shown in FIG. 4, whereby the lifting beam 8 is fastened to the guide rail 7 by sliding blocks 4, which engage behind longitudinal grooves 8*a* of the lifting beam 8. In this manner, the lifting beam 8 can be shifted into a desired longitudinal position, before being fastened to the guide rail 7, without any need for additional measures. As depicted in FIG. 2, an attachment plate 9 is fastened to a bottom end face of the lifting beam 8 via an interposed load-moment support 1 which, in turn, is mounted on the lifting beam 8 by sliding blocks 4.

In order to limit the lifting path, stop angles 11 are fastened to the lifting beam 8 and interacting with buffer elements 12, which are mounted to the longitudinal members 1, so as to define the two end positions of the lifting beam 8. The stop angles 11 and buffer elements 12 are also secured by sliding blocks 4 so as to allow a rapid change of the desired lifting distance by requiring only few manipulations.

The lifting beam 8 is displaced longitudinally by means of a cable balancer 13 which is arranged at the top region of the longitudinal members 1 and fastened by angle brackets 14 to the two longitudinal members 1 using sliding blocks 4. The cable balancer 13 has a cable 15 which is connected to the attachment plate 9 at the bottom end of the lifting apparatus. Of course, the cable balancer 13 is only one of a number of drive options. Another example includes a pneumatic pulling cylinder or the like for use as a drive mechanism.

Unwinding of the cable 15 thus results in rectilinear extension of the lifting beam 8 as a consequence of the effective weight force of the lifting beam 8. A raising and/or retraction of the lifting beam 8 is realized by winding up the cable 15 onto a cable drum 16 of the cable balancer 13.

The lifting beam 8 and the longitudinal members 1 may be configured as aluminum profiles which are made through an extrusion process and have a square or rectangular cross section Although not shown in detail in the foregoing figures, a horizontal member in the form of an aluminum profile may, for example, be fastened as intermediate element to the attachment plate 9, for supporting at one end, for example, a tool or a load-receiving member. Of course, it is certainly also possible to secure the tool directly to the attachment plate 9.

Figure 5:
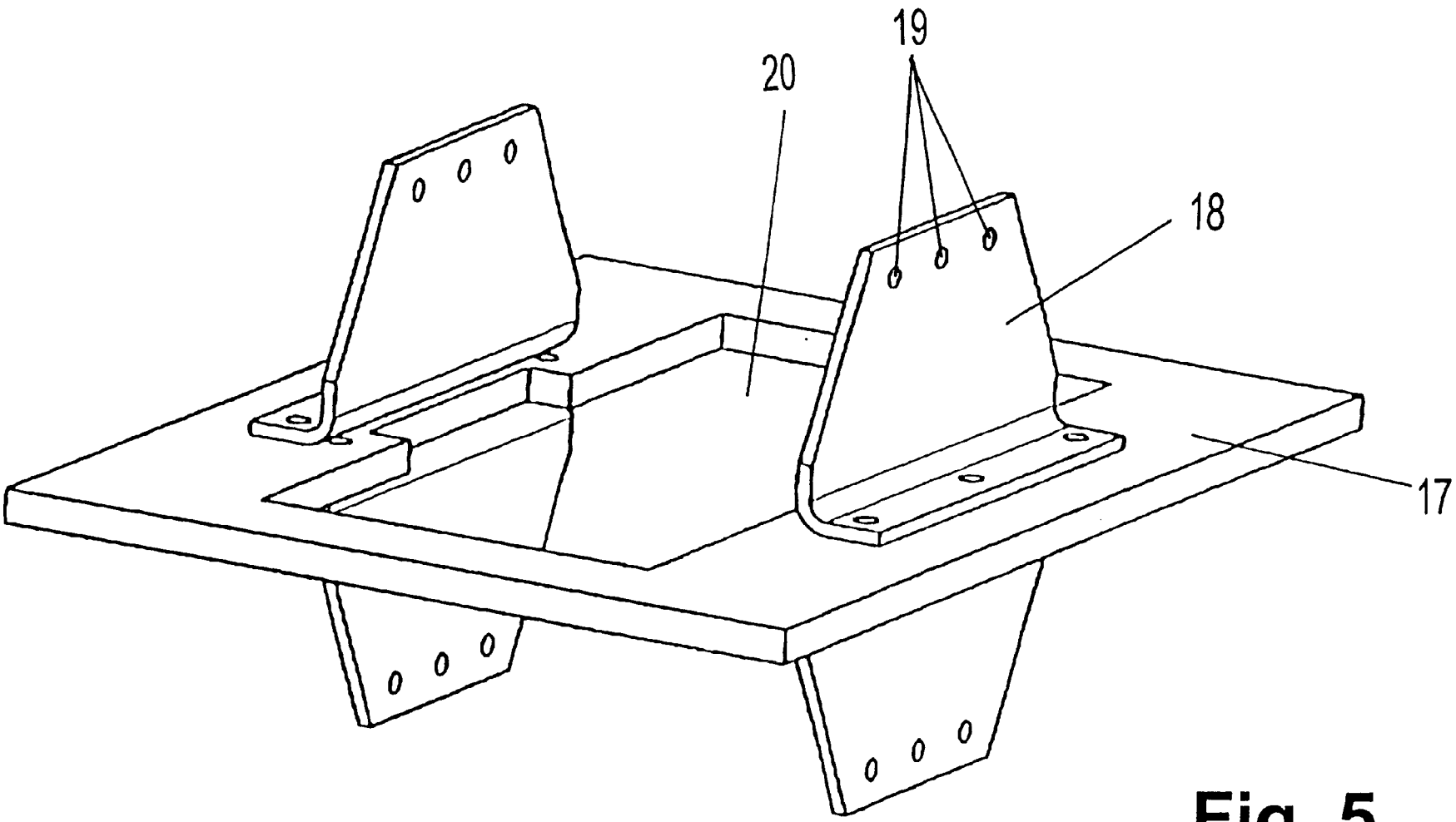
FIG. 5 is a schematic illustration of a mounting for securement of the lifting apparatus on a trolley.

Referring now to FIG. 5, there is shown a schematic illustration of a possible securement of the lifting apparatus to a trolley having a frame plate 17 which may, for example, be part of a trolley frame. Angles 18 are mounted to the frame plate 17 and formed with bores 19 for receiving sliding blocks 4 by which the frame plate 17 can be mounted to the longitudinal grooves 1*a* of the longitudinal members 1, as the longitudinal members 1 is placed through a large opening 20 of the frame plate 17. Also in this case, the longitudinal position of the frame plate 17, and thus of the trolley, on the lifting apparatus can be suited to the situation at hand and secured in place in an easy manner.

While the invention has been illustrated and described as embodied in a lifting apparatus for implementing a rectilinear movement of a handling device, it is not intended to be limited to the details shown since various modifications and structural changes may be made without departing in any way from the spirit of the present invention.

What is claimed is:

1. A lifting apparatus for implementing a rectilinear movement of a handling device, comprising:

a pair of longitudinal members arranged in parallel relationship in a common plane to define a space therebetween and securable to a stationary or movable carrying unit;

at least one connecting element rigidly interconnecting the longitudinal members;

a drive mechanism;

a lifting beam movable by the drive mechanism longitudinally along the longitudinal members and having attached thereon, directly or indirectly, a handling device; and a guide rail extending parallel to and supporting the lifting beam, said guide rail being received in guide elements, arranged in a longitudinally axially spaced apart relationship to the connecting element, for displacement in longitudinal direction in a freely running manner, as the lifting beam is moved by the drive mechanism, wherein the guide elements are arranged in the space between the longitudinal members and secured to the connecting element, wherein the longitudinal members and the lifting beam are formed with longitudinal grooves for engagement of sliding blocks so that the connecting element, the drive mechanism and the carrying unit are securable to the longitudinal members in any desired longitudinal position, and the guide rail is securable to the lifting beam in any desired longitudinal position.

2. The lifting apparatus of claim 1, wherein the lifting beam and the longitudinal members are configured as aluminum profiles made through an extrusion process and having a square or rectangular cross section.

3. The lifting apparatus of claim 1, wherein the guide elements include a recirculating linear ball bearing for guiding the guide rail in a linear direction.

4. The lifting apparatus of claim 1, wherein the connecting element is a metal plate.

5. The lifting apparatus of claim 1, wherein the drive mechanism is a cable balancer having a cable secured to a lower end of the lifting beam.

6. The lifting apparatus of claim 1, and further comprising an attachment element configured as a horizontal beam made of an aluminum profile, and a rigid load-moment support for securing the attachment element to the lifting beam via sliding blocks.

7. The lifting apparatus of claim 1, wherein the longitudinal members have stop members secured by sliding blocks for limiting a lifting path of the lifting beam.

8. A lifting apparatus, comprising:

a pair of spaced-apart longitudinal members defining a longitude axis and formed with grooves extending longitudinally in the direction of the axis;

a connecting element interconnecting the longitudinal members;

a drive mechanism;

a lifting beam operatively connected to a load-receiving member and movable by the drive mechanism in the direction of the axis, said lifting beam being provided with a groove extending longitudinally in the direction of the axis;

a support unit, positioned between the longitudinal member, for guiding the lifting beam as it moves in the axial direction, said support unit including a pair of guide elements mounted in longitudinally axially spaced-apart relationship to the connecting element, and a guide rail movably received in the guide elements and supporting the lifting beam; and fastening means in the form of sliding blocks for detachable securement to the grooves of the longitudinal members and the lifting beam to thereby permit positioning of the connecting element and the drive mechanism along a length of the longitudinal members, and of the guide rail along a length of the lifting beam at a desired location.

9. The lifting apparatus of claim 8, wherein the lifting beam and the longitudinal members are configured as aluminum profiles made through an extrusion process and having a square or rectangular cross section.

10. The lifting apparatus of claim 8, wherein the connecting element is a metal plate.

11. The lifting apparatus of claim 8, wherein the drive mechanism is a cable balancer having a cable secured to a lower end of the lifting beam.

12. The lifting apparatus of claim 1, and further comprising means for restricting a lifting path of the lifting beam, said means including a stop member detachably secured to the longitudinal members, and a pair of angle brackets mounted to axial end zones of the lifting beam for cooperation with the stop member.

* * * * *